US009142118B2

(12) United States Patent
Patenaude et al.

(10) Patent No.: US 9,142,118 B2
(45) **Date of Patent: *Sep. 22, 2015**

(54) EMERGENCY NOTIFICATION DEVICE AND SYSTEM

(71) Applicant: Belkin International, Inc., Playa Vista, CA (US)

(72) Inventors: Jean-Marc G. Patenaude, Sunnyvale, CA (US); Russell K. Jones, III, Palo Alto, CA (US)

(73) Assignee: Belkin International, Inc., Playa Vista, CA (US)

( * ) Notice: Subject to any disclaimer, the term of this patent is extended or adjusted under 35 U.S.C. 154(b) by 209 days.

This patent is subject to a terminal disclaimer.

(21) Appl. No.: 13/653,323

(22) Filed: Oct. 16, 2012

(65) Prior Publication Data

US 2013/0039499 A1 Feb. 14, 2013

Related U.S. Application Data

(60) Continuation of application No. 13/187,255, filed on Jul. 20, 2011, now Pat. No. 8,289,157, which is a division of application No. 12/121,677, filed on May 15, 2008, now Pat. No. 8,018,337.

(60) Provisional application No. 60/953,740, filed on Aug. 3, 2007.

(51) Int. Cl.

| | |
|---|---|
| ***G08B 1/08*** | (2006.01) |
| ***G08B 25/00*** | (2006.01) |
| ***G08B 25/08*** | (2006.01) |

(52) U.S. Cl.

CPC ..... *G08B 25/009* (2013.01); *G08B 1/08* (2013.01); *G08B 25/08* (2013.01)

(58) Field of Classification Search

None

See application file for complete search history.

(56) References Cited

U.S. PATENT DOCUMENTS

| | | | |
|---|---|---|---|
| 4,060,803 | A | 11/1977 | Ashworth, Jr. |
| 4,241,335 | A | 12/1980 | Barnes |
| 4,390,750 | A | 6/1983 | Bartelink |
| 4,851,823 | A | 7/1989 | Mori |
| 5,061,916 | A | 10/1991 | French et al. |
| 5,144,661 | A | 9/1992 | Shamosh et al. |
| 5,225,997 | A | 7/1993 | Lederer et al. |
| 5,283,816 | A | 2/1994 | Gomez Diaz |

(Continued)

OTHER PUBLICATIONS

Journal News Brief for TELALERT, Machine Design, vol. 69, No. 5, Mar. 6, 1997, p. 30; cited by applicants.

*Primary Examiner* — Travis Hunnings

(74) *Attorney, Agent, or Firm* — Bryan Cave LLP

(57) ABSTRACT

An audio warning monitoring device, system and method including an audio detector, one or more audio screens to determine if monitored sound is an alarm, a processor or logic device to potentially analyze sound data and then instruct a transmitter to send a message with the monitoring device identification and signals representing sound detected by the audio detector to a server. The computer server analyzes the message and authenticates the audio detector, looks up user data associated with the detector, and contacts a user from previously stored user data in order to notify of the alert and then relay the audio signals in an audio file. At the user's option, the server may contact a staffed or automated monitoring center. Here a human operator may listen to the signals in the audio file and take appropriate action, such as calling the location of the alarm for verification or contacting a professional first responder(s).

20 Claims, 3 Drawing Sheets

(56) References Cited

U.S. PATENT DOCUMENTS

| | | | | |
|---|---|---|---|---|
| 5,400,011 | A * | 3/1995 | Sutton | 340/566 |
| 5,465,297 | A | 11/1995 | Azem | |
| 5,565,844 | A | 10/1996 | Bedrosian | |
| 5,566,339 | A | 10/1996 | Perholtz et al. | |
| 5,629,687 | A | 5/1997 | Sutton et al. | |
| 5,717,378 | A | 2/1998 | Malvaso et al. | |
| 5,764,729 | A | 6/1998 | Black et al. | |
| 5,797,852 | A | 8/1998 | Karakasoglu et al. | |
| 5,799,062 | A | 8/1998 | Lazzara et al. | |
| 5,812,054 | A | 9/1998 | Cohen | |
| 5,842,182 | A | 11/1998 | Bonner et al. | |
| 5,905,436 | A | 5/1999 | Dwight et al. | |
| 5,923,731 | A | 7/1999 | McClure | |
| 5,923,732 | A | 7/1999 | Nakamura | |
| 5,926,100 | A | 7/1999 | Escolar | |
| 5,930,355 | A | 7/1999 | Poston | |
| 5,991,429 | A | 11/1999 | Coffin et al. | |
| 6,049,273 | A | 4/2000 | Hess | |
| 6,061,447 | A | 5/2000 | Poston | |
| 6,081,546 | A | 6/2000 | Williamson et al. | |
| 6,094,134 | A | 7/2000 | Cohen | |
| 6,104,785 | A | 8/2000 | Chen | |
| 6,134,303 | A | 10/2000 | Chen | |
| 6,147,601 | A | 11/2000 | Sandelman et al. | |
| 6,160,477 | A | 12/2000 | Sandelman et al. | |
| 6,204,760 | B1 | 3/2001 | Brunius | |
| 6,215,404 | B1 * | 4/2001 | Morales | 340/577 |
| 6,388,399 | B1 | 5/2002 | Eckel et al. | |
| 6,442,241 | B1 | 8/2002 | Tsumpes | |
| 6,553,100 | B1 | 4/2003 | Chen et al. | |
| 6,658,091 | B1 * | 12/2003 | Naidoo et al. | 379/37 |
| 6,658,123 | B1 | 12/2003 | Crutcher | |
| 6,686,838 | B1 | 2/2004 | Rezvani et al. | |
| 6,850,601 | B2 * | 2/2005 | Jones et al. | 379/45 |
| 6,943,681 | B2 | 9/2005 | Rezvani et al. | |
| 7,010,097 | B2 | 3/2006 | Zellner et al. | |
| 7,126,467 | B2 | 10/2006 | Albert et al. | |
| 7,129,833 | B2 | 10/2006 | Albert | |
| 7,148,797 | B2 | 12/2006 | Albert | |
| 7,170,404 | B2 | 1/2007 | Albert et al. | |
| 7,173,525 | B2 | 2/2007 | Albert | |
| 7,250,854 | B2 | 7/2007 | Rezvani et al. | |
| 7,376,565 | B2 | 5/2008 | Gandhi et al. | |
| 7,477,143 | B2 | 1/2009 | Albert | |
| 7,477,144 | B2 | 1/2009 | Albert | |
| 7,522,035 | B2 | 4/2009 | Albert | |
| 7,555,528 | B2 | 6/2009 | Rezvani et al. | |
| 7,701,331 | B2 | 4/2010 | Tran | |
| 7,796,023 | B2 | 9/2010 | Rezvani et al. | |
| 7,825,813 | B2 | 11/2010 | Farhan | |
| 7,904,299 | B2 | 3/2011 | Gandhi et al. | |
| 8,018,337 | B2 * | 9/2011 | Jones et al. | 340/539.14 |
| 8,024,073 | B2 | 9/2011 | Imes et al. | |
| 8,082,065 | B2 | 12/2011 | Imes et al. | |
| 8,099,195 | B2 | 1/2012 | Imes et al. | |
| 8,289,157 | B2 * | 10/2012 | Patenaude et al. | 340/539.14 |
| 2006/0205384 | A1 | 9/2006 | Chang | |
| 2007/0024451 | A1 * | 2/2007 | Albert | 340/573.1 |

* cited by examiner

EMERGENCY NOTIFICATION DEVICE AND SYSTEM

CROSS-REFERENCE TO RELATED APPLICATIONS

This is a continuation application of U.S. patent application Ser. No. 13/187,255, filed Jul. 20, 2011. U.S. patent application Ser. No. 13/187,255 is a divisional application of U.S. patent application Ser. No. 12/121,677, filed May 15, 2008, which claims the benefit of U.S. Provisional Patent Application No. 60/953,740, filed Aug. 3, 2007. U.S. patent application Ser. No. 13/187,255, U.S. patent application Ser. No. 13/187,255, and U.S. Provisional Patent Application No. 60/953,740 are incorporated herein by reference in their entirety.

FIELD OF THE INVENTION

The present invention relates to emergency detection and warning equipment, and more specifically remote emergency or warning notification devices.

DESCRIPTION OF THE BACKGROUND

In an emergency it is important to rapidly and accurately alert both authorities and property owner about the existence of the emergency situation. Rapid notification may make the difference between containment of an emergency situation, such as a fire, and total loss of properties or building(s). In extreme cases, this may make the difference between life and death. If the emergency situation is a robbery or other security breach, rapid communication of the emergency situation and information relating to the emergency situation may allow for apprehending a suspect, rather than loss of property or potential injury to inhabitants.

Fire danger provides a substantial risk to property and lives. According to National Fire Protection Association 2005 statistics, in that year 1,600,000 fires were reported nationally resulted in 17,925 civilian injuries, 3,675 civilian deaths, and over 10 billion dollars in damage. More rapid notification could result in mitigation of these losses.

1. If the building does not have any people in it at the time of an emergency, then potentially no one will hear the alarm sound. In the case of a fire, the emergency may only be noted once neighbors see flames or smoke. By the time smoke or flames are spotted, the structure may have experienced considerable damage or total loss and could even pose a danger to surrounding structures. At night, it is much less likely that neighbors will spot a fire until substantial damage has occurred. For remote structures that do not have proximate neighbors or that are only occupied seasonally, the risk of total loss if uninhabited is significantly greater.
2. Certain inhabitants within a structure may not respond to an alarm. Children are known to sleep especially deeply and are difficult to rouse, even if an alarm is sounding. Older adults may have hearing difficulties, may remove hearing aids at night, and may use sleep aids that result in these individuals being more difficult to rouse. In addition, pets, even if they hear an alarm, will not be able to escape a structure during an emergency.
3. Some alarms, such as static motion detectors or sensors on windows or doors, sound an alarm when motion is detected or a window or door is opened. However, for simple and inexpensive systems, such alarms are not otherwise connected to outside parties. If the alarm is tripped, sound and/or lights are used as the primary deterrent of a potential intruder. If a user wishes to upgrade such a system generally requires replacement of the lower cost system, to a much higher cost integrated system.

To address these problems, some devices have been designed to mitigate such problems. One such device is described in U.S. Pat. No. 6,850,601. This device is a security detection system that includes a detection unit capable of detecting an emergency or warning condition, such as a break in. The unit is in communication with a remote central server. The detection unit may be connected to the server by a dial up modem and connected to a telephone seizure unit. If the emergency condition is detected, the detection unit blocks the telephone from communicating through a telephone line, but does allow this detection unit to send electronic data to the server. The unit may be able to do this even if the line from the phone to the unit is cut, or if the phone line is opened (as by actuating a handset to get a dial tone or lifting a phone from a base on older phones). Once information is sent to the server, a server database may send the information to one or more designated recipients, such as a public or private first responder or to a property owner. The server also monitors whether the designated recipient has responded to the information. If there has been no response, the information is sent to a staffed or automated monitoring station. The designated party may send additional information to the detection unit via the server.

It is an object of the invention to provide a low cost solution to property owners to allow remote monitoring of audio alarms and access to audio information.

SUMMARY OF THE INVENTION

The above and other objects are achieved with a method and system for audio monitoring of warning alarms. In one embodiment, this can be a device including an audio detection component, a processor or logic device, a transmission component and a downstream relay, such as a server that can contact a decision maker who reviews an audio file from the audio detection component. The audio detection component allows detection of an alarm, which may be up to 100 feet or more away from the device. The processor or logic unit receives an alert, which is screened using various screening components. These screening components may be one or more of the following group: a sound level filter (which may include a switch allowing a user to set a threshold sound level for triggering the alarm), a tone range filter, and a sound duration processor. If the processor determines that the screened audio data is a warning alarm, an associated transmission component sends a message with audio information representing the audio data and contacts a server. A server may include, for example, any application or device that performs services for clients as part of a client-server architecture. During the transmission of the message an acknowledgement signal from the server could be sent back. The message sent to the server at least includes a signal to identify the emergency notification device and optionally audio information from the audio detection component with screened audio data, or a means to relay the audio information to the server. The signal to identify the emergency notification device is correlated to contact data known to be stored in the server.

An alternative characterization of the invention is a system including the device as above and a linked remote server. This linked remote server may be contacted by the device using a phone land line, a cellular phone connection, using a wireless transfer protocol such as IEEE 802.11 Wi-Fi for example, or by any other means of communication. The remote server identifies the emergency notification device, looks up associated contact data (such as address where the device is located, and backup contact phone numbers, e-mail addresses, text message contact information, etc.) The server then transmits to at least one contact an automated message and optionally the audio file. If the user has instructed the server to a heightened security level or if the contact data does not result in a potential acknowledge signal (e.g., the message goes to voicemail), the server may transmit the audio file and alert data to a staffed monitoring center, potentially in the future an automated monitoring center that notifies authorities. Operators at the staffed monitoring center may then determine the nature of the information in the audio file that generated the alarm and the location where the alarm is sounding to attempt to reach the inhabitants and/or contact a first responder (e.g., police, fire department, etc.).

BRIEF DESCRIPTION OF THE DRAWINGS

To facilitate further description of the embodiments, the following drawings are provided in which.

DETAILED DESCRIPTION OF EXAMPLES OF EMBODIMENTS

Some embodiments include a system. The system can comprise an audio monitoring device, and the audio monitoring device can comprise an audio detection component and a transmission component. Further, the system can comprise a server located remotely from the audio detection component. The server can be configured to communicate with the audio monitoring device. Meanwhile, the transmission component can be configured to send device identification data and audio data to the server, the device identification data can be associated with user data, the server can be configured to generate an alert to at least one user, and the alert can comprise the device identification data and the audio data together.

Figure 1:
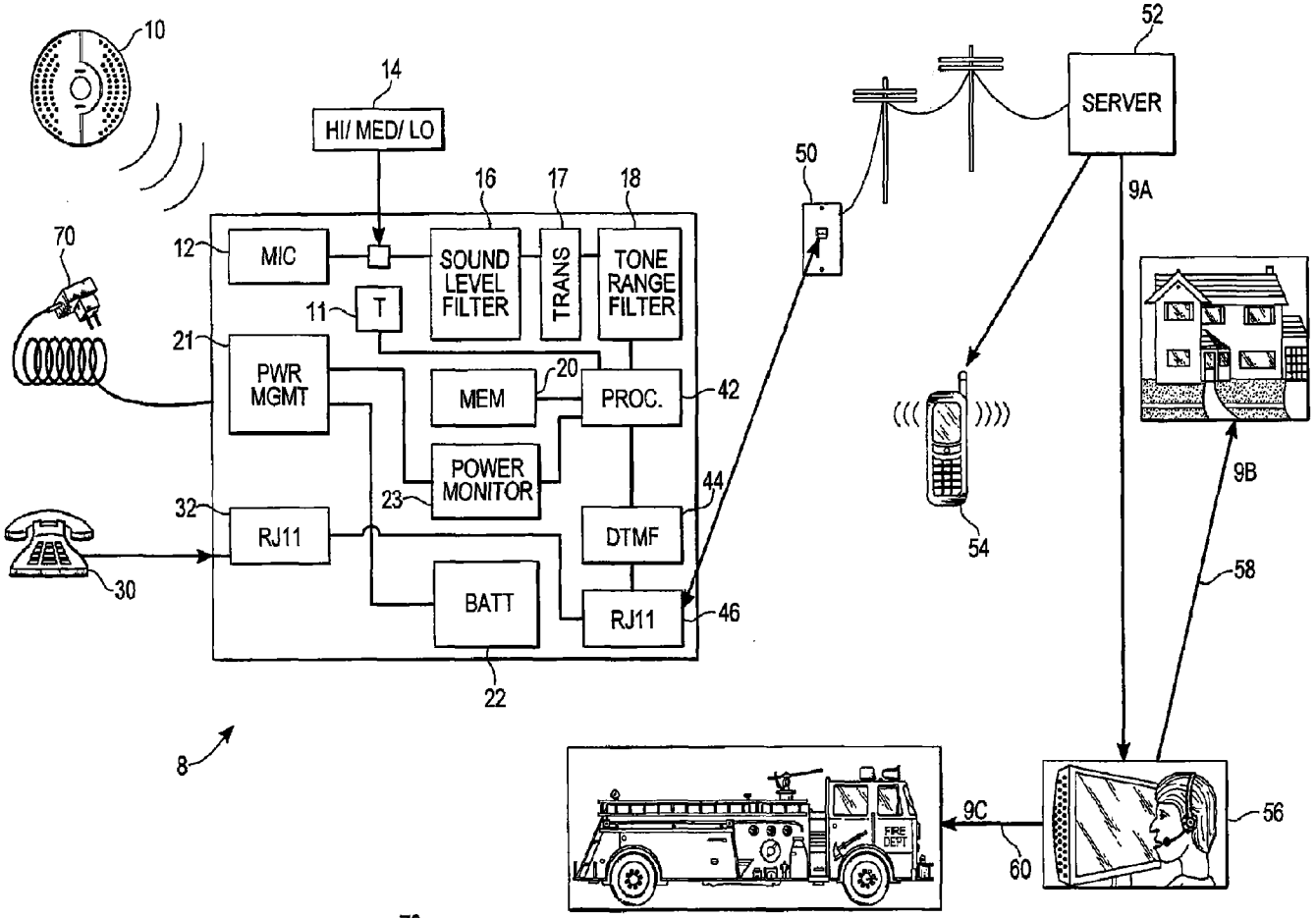
FIG. 1 is an overall diagram of an emergency detector and elements of an embodiment of the emergency detection device.

With reference to FIG. 1 an emergency detector 10 may be a smoke detector, a heat detector, a carbon monoxide detector, a burglar alarm, a motion sensor, a water detector to detect flooding, or any other similar emergency detection device either known or to be developed in the future. The one common feature of such emergency alarm detectors is that they provide an audible indication of an emergency condition.

This audio alert is detected by unit 8. On unit 8, a microphone 12 which continually monitors ambient sound detects the loud alarm sound.

An optional sound level switch (physical or embedded in electronic logic or software) 14 may set a threshold detection level. A "switch" includes any fixed or programmable device set by the user, allowing sensitivity control. Sound detection may be set at a certain sensitivity level. Sound exceeding this threshold triggers activation of the rest of the system.

The audio signal passes through a sound level filter 16. If this signal meets or exceeds a pre-determined volume level, the signal may be sent to a tone range filter 18 to be used to distinguish or filter out tones or background noise not within the normal audio alarm frequencies (e.g., dog barking, loud music, etc.). This may all be integrated through a processor 42 (e.g., a microprocessor), or a logic controller component.

Processor 42 may analyze the sound level and tone range from sound level filter 16 and tone range filter 18 or directly from the microphone 12 and note the duration of the audio signal. If the duration exceeds a threshold, the processor 42 considers this an alarm condition and may store a recording of audio signal in memory 20. This signal may be either filtered or unfiltered sound.

As soon as an alarm condition is identified by the processor 42, a phone dialer 44 (operating through a phone jack 46 and connected to a household phone jack 50 by a wire) allows the unit 8 to contact server 52. This may be done using standard POTS service, VoIP service or any other means of telecommunication including but not limited to wireless or cellular communications. If the service center is busy the processor may be instructed to either dial an alternative number and/or retry multiple times. Once connected to the server 52, the detector unit 8 transmits a unique identification sequence to the server 52. The identification may include the type of alarm that is being transmitted. The server 52, using automated database, identifies the specific detector unit which is transmitting. The server 52 may send back a confirmation tone or tone sequence acknowledgment sent to confirm that the unique identification has either been accepted or rejected by the server. If the identification is rejected or a time interval passes (e.g., for example, 30 seconds or greater timeout) the emergency notification device terminates transmission and retries additional times before resetting.

Upon authentication of the emergency detection device 8, the emergency detection device then either sends the audio file saved in a buffer memory or sends a direct audio data/track transmission from sound monitor 12 to server 52. This may be sent as uncompressed or compressed audio data, including but not limited to, for example, an MP3 audio data file. In the situation of the direct connection of microphone 12 to server 52 on an open phone line, then near real time ambient sounds (filtered or not) are transmitted, representing sounds occurring at the location surrounding the emergency detection unit 8, and an audio file is created at the service center.

The server 52 may then take one of a number of actions. A call may be sent to a phone 54 associated with the unique identification of emergency detection unit 8. This may be a cell phone of property owners, a phone of a property caretaker or neighbor, or other designated party. This person reviews the audio file and decides what action should be taken, i.e., whether the audio file represents a real or a false alarm. Optionally, server 52 could also send the alert data and optionally the audio file to staffed or automated monitoring center 56. This monitoring center 56 will allow the potential review of the audio file by an agent. The agent at the monitoring center 56 may call the property location in an attempt to verify an alert, call alternative numbers to verify the emergency, or contact a third party, fire department, police department, property manager, or other first responder after review of the audio file and determining that a true emergency situation exists.

As shown in FIG. 1, the device may have a number of optional features. A plug 70 may be used to power the device. Alternatively (or in addition) a battery 22 may provide the unit power or auxiliary power. The power is fed through power management module 21 which provides power to the elements of the system. The phone line may also power the device.

The phone jack 46 may also be linked to secondary phone jack 32. A phone 30 may be plugged into phone jack 32. The use of this two jack system on the device 8 allows the device to be used without requiring a separate wall phone jack. Alternative configurations may allow the device 8 to communicate over a computer network or be a wireless device that communicates via cellular, wireless data networks to the server or directly with a personal computer, cell phone, or other wireless technology.

The present embodiment can hear an audio detector alarm up to 100 feet or more away. In particular, it is able to detect standard approved smoke detector.

The basic components of the invention are adaptable to analog phone lines, VoIP phone lines, wireless cellular phone communication, or any other type of data communication protocols including IEEE 802.11 Wi-Fi protocols, Ethernet and others.

The user can subscribe to various levels of protection. In one level of protection, a fully automated protection plan would be provided by the server 52. When the server 52 detects an alarm, a transmission of notifications may be sent. These could be automated phone calls with a recorded message and a recording of sound from the microphone of the device. Alternatively, or in addition, the server 52 may send out an electronic message, such as email, SMS, MMS, text message, or other electronic notification to a secondary device.

In another level of protection, a staffed or automated monitoring center could also respond to the alert.

Figure 2:
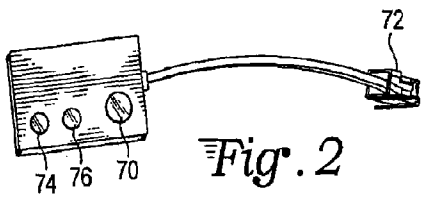
FIG. 2 is a top view of an embodiment of an emergency detector notification device that is plugged into a phone system.

With reference to FIG. 2, the device is shown having a registered phone plug 72 attached by a wire to the body of the emergency detection device. An indicator light 70 allows indication that the device is working. This may be a very low power LED light. Buttons 74, 76 may be pressed to test and reset the device, respectively, or could be combined. Reset button 76 may be used for false alarms to reset the server 52 of FIG. 1. Test button 74 may serve two functions. First, this may be used to calibrate the server 52. In addition, it may also serve to ensure that the alarm is properly functioning.

Figure 3:
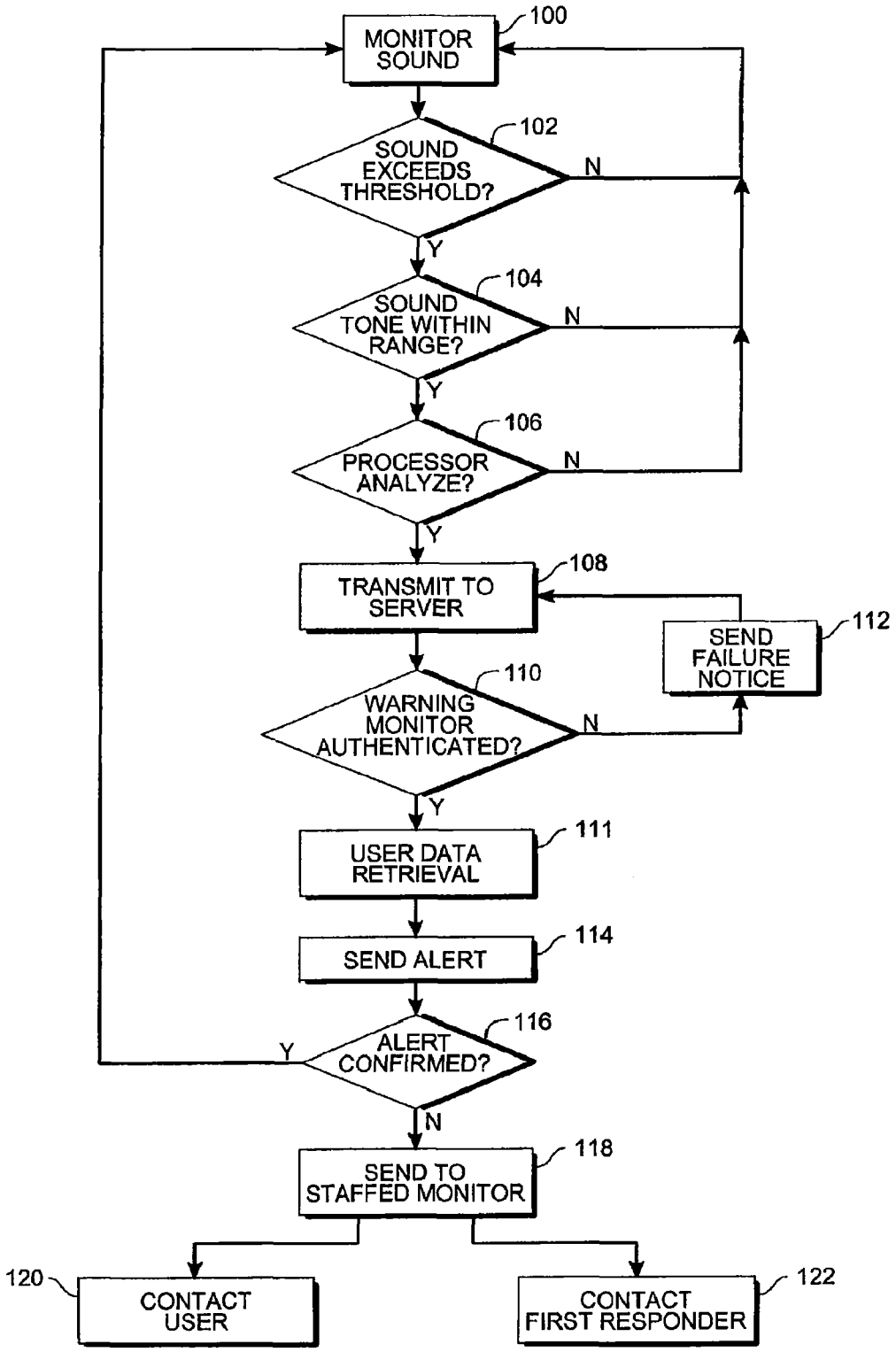
FIG. 3 is a flow chart of the operation of one embodiment of the present system.

With reference to FIG. 3, a flow chart shows operation of the basic system in which sound is continuously monitored (block 100). An initial filter determines if monitored sound exceeds a given threshold (block 102). A user may be able to set this threshold. The device may include a switch in which a user selects the sound threshold (e.g., high, medium, low), setting device sensitivity. If the sound does not exceed the threshold the device simply continues to monitor the ambient sound (block 100). If the threshold is exceeded, the device determines if the tone measured is within a selected range (block 104). If the tone is consistent with an alarm, the sound data is sent to a processor. (The term "processor" should be understood to mean either a microprocessor, a microcontroller or a logic device such as a PLD.) If not, the device continues to monitor the ambient sound (block 100). The processor analyzes the sound data (block 106). This may include determining the duration of the sound signal for example, or any other type of alarm sound signature, such as, for example, its cadence, its frequency or its sound envelope. If the sound data is consistent with an alarm, the device will transmit the device identification and audio verification, potentially as a sound audio file (e.g., MP3 file, way file, audio data or other digital or analog electronic audio information with signals representing sounds captured by the microphone and filtered by the processor, to the server.) Blocks 100-108 may occur at the audio detection device or in a central unit. At the server, the server device attempts to authenticate the detection device ID (block 110). If the device is not authenticated a failure notice is sent (block 112) to the audio transmission device, which would attempt again to contact the server (block 108). If the device is authenticated, the device either unpacks the audio file in a message sent by the transmission component or creates an audio file with sounds captured by the microphone in the case of a direct connection to the microphone. The server then looks up in a database the user contact data (block 111), and then send an alert to using the contact data (block 114). Most commonly, this will be a replay of the captured audio and a created or recorded message to one or more phone numbers. The property owner may request to have a number of phones or mobile devices contacted by the server at the same time. The user who receives the alert may determine whether the sound is a false alarm and then may have the option of summoning a responder (by calling the police department, fire department, 911, etc.). Alternatively, the user may be able to simply reset the alarm. (return to block 100). If a higher class of service is set up the audio file and alert data would be sent to a staffed or automated monitoring center (block 118). Here an operator could listen to the audio data and take an appropriate action, such as calling the phone number of the address where the alarm is located (block 120) or calling a first responder (block 122).

One of skill in the art will understand that the various embodiments could be characterized in different ways. In addition, various substitutions and alterations are possible. A single audio monitoring device could monitor a number of different household alarms, such as a fire alarm, water detection alarm, motion detector, and burglar alarms. If these alarms produce a different tone, the audio monitoring device could distinguish each tone and the server could correspondingly be programmed to respond to each tone with a customized message and potentially different alerts. The transmission device may be a phone land line, a cellular phone connection, an internet data connection (including cable, satellite, DSL, etc.), a wireless data communication protocol (such as Bluetooth®, IEEE 802.11 Wi-Fi 802.16 WiMax and others), wireline data communication protocols such as Ethernet, a networked device, etc. The processor may have programming or components that allow the processor to perform a number of the screening functions, including sound and tone screening, length of alarm screening, or other audio screening. Alternatively these may be performed by components other than a processor. The alarm detector may, in addition to the audio sound, send a signal to the monitoring device, via a transmission method such as a wireless connection.

The monitoring device may in some embodiments, be manufactured as part of an audio warning device, such as a smoke detector having this component integrated into the detector.

The audio alarm device may include a number of additional features. In the illustrated embodiment, the audio detection component 8 is shown linked by wires to a telephone input and output. The device could also be configured to have a wireless communication transmitter, such that the communication component is a wireless link that communicates to a network. This could use any of a number of wireless communication protocols.

The processor 42 and/or the configuration of the filters could be configured to allow a training mode. In the training mode the device could "learn" to recognize both an alarm, and a number of background noises. For example, if a "train" button/function were activated and then an emergency alarm activated, the sound level filters and tone range filters and/or the processor could adjust to ensure that the alarm could be detected. Such adjustment could include, but are not limited to, adjustment as to tones detected, recognition of patterns, adjustment of gain settings, and other setting adjustments. In addition or alternatively, a training mode could be used to recognize background noises, either with or without the additional audio contribution from the alarm.

Another feature could be a translator. For the purposes of this document, "translate" means to convert an audio sound into any different sort of data that is more easily sent over a telephone line. Any component which is a "translator" is one able to translate, as defined herein. Translating a signal could be detecting an alarm, and having the frequency altered so that the signal could be sent over a bandwidth-limited phone line. Alternatively, the translation could be converting the detected alarm into a different signal, such as a voice simulation of the time and/or location and/or duration of the alarm. Alternatively, the translator could produce a tone signal, recognized by a server as indicative of the alarm. In FIG. 1, the translator 17 received the audio signal from the sound level filter and passes the sound signal to the tone level filter. Alternative configurations are possible, as all configurations illustrated are exemplary.

Another feature that may be added is a temperature sensor, such as element 11 in FIG. 1. This temperature sensor could allow the system to be activated if the temperature exceeds or falls below a threshold. Low temperature could indicate a broken furnace or loss of structure integrity during cold weather. High temperature could indicate a fire, and be used in addition to the audio monitoring to provide additional information during an emergency event. Temperature sensor 11 may be connected to the processor to allow production of a signal indicating that the temperature has moved above or below a high or low threshold.

In addition a power monitoring feature could be included, as shown with element 23 on device 8 in FIG. 1. This could monitor the power to the alarm detection unit itself from any power source, including the power line, the phone line or the battery, or it could be wired to detect power interruption to the building. This could be just a simple plug, allowing communication through a phone line (which would remain working during a blackout) that power to a structure has been interrupted. The audio detector could also be configured to detect the "chirp" or other audio indicator from an audio alarm that sound to note that a battery is low. This could be detected and transmitted to the server.

Figure 4:
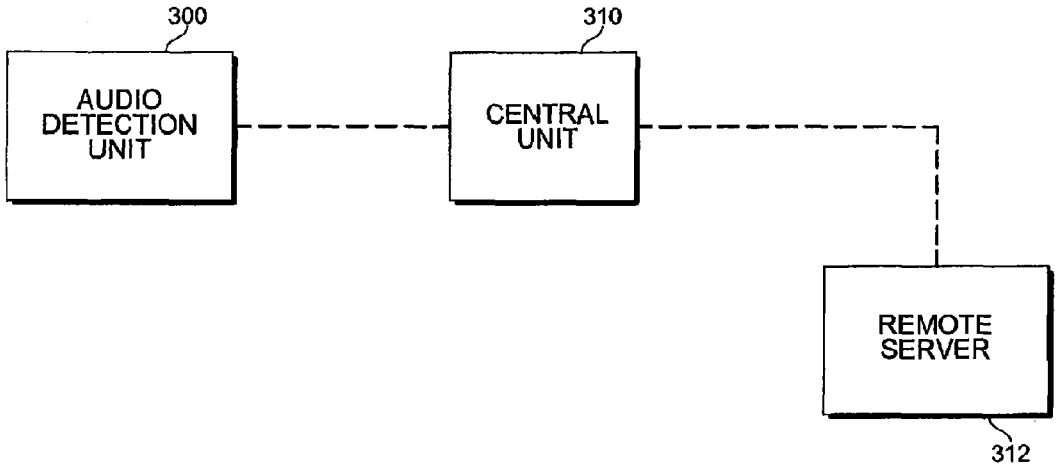
FIG. 4 is a block diagram of an embodiment of an audio detection unit configured to relay to a central unit.

The audio detection unit may be a single, standalone unit. Alternatively, the audio detection unit could be one of a plurality of independent or linked units. Some structures have multiple rooms separated by both distance and sound obstructions (such as doors, elevation changes, corners and other structural features that reduce sound travel). A number of audio detection units may be used in such a structure. These could either each be linked to a communication component that communicates with a server, or could all be linked (either through hard wiring or could have wireless communication) with a central unit. This is shown in FIG. 4. The method to link the units can include, as an example, power line networking or wireless technologies. In FIG. 4, the audio detection unit 300 sends signal to a central unit 310. Central unit 310 is configured to receive monitoring signals from anyone of the audio detection units. If any of the audio detection units relay a signal indicative of an alarm sounding or other detection of an emergency condition, a signal is sent (through either wireless or telephone or other wired signal sending means) to the server 312.

An "emergency condition alarm" may be either a device within a structure that produces an audio signal if a condition exists (e.g., water detector, smoke detector, burglar alarm, temperature detector, carbon monoxide detector, heat detector, etc.). In addition, the emergency condition alarm can also be a whistle or tone generator activated by an individual in an emergency situation. For example, if a fall occurs and an occupant is unable to get up, a tone generator worn about the neck can be used to provide a signaling tone to alert the system that help is required.

What is claimed is:

1. A system comprising:

a detection device comprising:

a detection component; and a transmission component configured to communicate with the detection component;

and a server located remotely from the detection component, the server being configured to communicate with the transmission component;

wherein:

the detection component is configured to detect an alarm condition;

the transmission component is configured to provide device identification data and alarm signal data to the server, the device identification data and the alarm signal data corresponding to the alarm condition detected by the detection component; and the server is configured to provide an alarm condition alert to at least one user, the alarm condition alert comprising the device identification data and the alarm signal data together.

2. The system of claim 1 wherein:

the alarm signal data comprises an indication of a change of temperature at the detection component.

3. The system of claim 2 wherein:

the indication of the change of the temperature at the detection component further comprises an indication that the temperature has moved above a high threshold temperature or below a low threshold temperature.

4. The system of claim 1 wherein:

the alarm signal data comprises an indication of an electrical power interruption.

5. The system of claim 1 wherein:

the alarm signal data comprises an indication of a presence of water at the detection component.

6. The system of claim 1 wherein:

the alarm signal data comprises an indication of a presence of at least one of smoke, carbon monoxide, or heat at the detection component.

7. The system of claim 1 wherein:

the device identification data comprises a type of the alarm condition.

8. The system of claim 1 wherein:

the device identification data comprises an identification of the detection component.

9. The system of claim 1 wherein:

the detection device comprises a power monitoring component configured to communicate with the transmission component;

the power monitoring component is configured to detect a low battery condition of the detection component;

the transmission component is configured to provide low power data to the server, the low power data corresponding to the low battery condition of the detection component;

and the server is configured to provide a low power alert to the at least one user.

10. The system of claim 1 wherein:

the server is configured to wirelessly communicate with the transmission component.

11. The system of claim 1 wherein:

the server comprises a database; and the database comprises contact data for each user of the at least one user, the contact data being associated with the detection component.

12. A system comprising:

a detection device comprising:

a detection component; and a transmission component configured to communicate with the detection component;

and a server located remotely from the detection device, the server being configured to wirelessly communicate with the transmission component;

wherein:

the detection component is configured to detect an alarm condition;

the transmission component is configured to provide device identification data and alarm signal data to the server, the device identification data and the alarm signal data corresponding to the alarm condition detected by the detection component;

the server is configured to provide an alarm condition alert to a user, the alarm condition alert comprising the device identification data and the alarm signal data together;

the device identification data comprises an identification of the detection component;

the server comprises a database; and the database comprises contact data for the user, the contact data being associated with the detection component by the device identification data.

13. The system of claim 12 wherein:

the alarm signal data comprises an indication of a change of temperature at the detection component.

14. The system of claim 13 wherein:

the indication of the change of the temperature at the detection component further comprises an indication that the temperature has moved above a high threshold temperature or below a low threshold temperature.

15. The system of claim 14 wherein:

the detection device comprises a power monitoring component configured to communicate with the transmission component;

the power monitoring component is configured to detect a low battery condition of the detection component;

the transmission component is configured to send low power data to the server, the low power data corresponding to the low battery condition of the detection component; and the server is configured to generate a low power alert to the user.

16. The system of claim 15 wherein:

the server is configured to provide the alarm condition alert to a mobile device of the user.

17. The system of claim 12 wherein:

the detection device comprises a first detection device, and the detection component comprises a first detection component;

the system further comprises a second detection device comprising a second detection component;

the server is located remotely from the second detection component; and the second detection component is configured to detect the alarm condition.

18. The system of claim 17 wherein:

the second detection component is configured to communicate with at least one of the transmission component or a second transmission component different from the transmission component.

19. A method comprising:

providing a detection component;

providing a transmission component configured to communicate with the detection component;

and providing a server located remotely from the detection component, the server being configured to wirelessly communicate with the transmission component;

wherein:

the detection component is configured to detect an alarm condition;

in response to the detection component detecting the alarm condition, the transmission component is configured to provide device identification data and alarm signal data to the server, the device identification data and the alarm signal data corresponding to the alarm condition detected by the detection component;

in response to receiving the device identification data and the alarm signal data, the server is configured to provide an alarm condition alert to a user, the alarm condition alert comprising the device identification data and the alarm signal data together;

the device identification data comprises an identification of the detection component;

the server comprises a database; and the database comprises contact data for the user, the contact data being associated with the detection component by the device identification data.

20. The method of claim 19 wherein:

the alarm signal data comprises an indication that a temperature at the detection component has moved above a high threshold temperature or below a low threshold temperature.

* * * * *